US010378136B2

(12) United States Patent
Firth et al.

(10) Patent No.: US 10,378,136 B2
(45) Date of Patent: Aug. 13, 2019

(54) HANDHELD FELTING DEVICE

(71) Applicants: Harry Firth, Stillwater, MN (US); Robbin Firth, Stillwater, MN (US)

(72) Inventors: Harry Firth, Stillwater, MN (US); Robbin Firth, Stillwater, MN (US)

( * ) Notice: Subject to any disclaimer, the term of this patent is extended or adjusted under 35 U.S.C. 154(b) by 386 days.

(21) Appl. No.: 15/173,187

(22) Filed: Jun. 3, 2016

(65) Prior Publication Data

US 2016/0281285 A1 Sep. 29, 2016

Related U.S. Application Data

(63) Continuation-in-part of application No. 13/912,573, filed on Jun. 7, 2013, now Pat. No. 9,702,072.

(60) Provisional application No. 61/690,236, filed on Jun. 22, 2012.

(51) Int. Cl.
*D04H 17/00* (2006.01)
*D06C 11/00* (2006.01)

(52) U.S. Cl.
CPC ..... *D04H 17/00* (2013.01); *D06C 11/00* (2013.01)

(58) Field of Classification Search
CPC ..... D04H 17/00; D01G 33/00; D06C 11/00; D06C 23/00; D06C 19/00; D06C 2700/15; D06C 2700/20; A47L 25/08; A47L 13/02; A47L 13/022; A47L 13/10; A22C 9/007; D06F 3/00; D06F 3/04; D06F 5/00; D06F 75/38; D06F 75/34; D06F 75/30
USPC ..... 452/146, 147, 141, 102; D7/682; D8/78, D8/77, 75
See application file for complete search history.

(56) References Cited

U.S. PATENT DOCUMENTS

| | | | | | |
|---|---|---|---|---|---|
| D33,703 | S | * | 12/1900 | Whelen | D25/158 |
| 739,813 | A | | 9/1903 | Beardsley | |
| D48,170 | S | | 11/1915 | Colley | |
| D57,334 | S | | 3/1921 | Hanford | |
| 1,401,719 | A | | 12/1921 | Myers | |
| 1,436,921 | A | | 11/1922 | Stanley | |
| 1,493,444 | A | | 5/1924 | Burch | |
| D64,894 | S | * | 6/1924 | Fitzgerald | 601/107 |
| 1,598,338 | A | | 8/1926 | Blaine, Jr. | |
| 1,987,390 | A | | 1/1935 | Davis | |
| 2,008,260 | A | | 7/1935 | Reineman | |
| D104,360 | S | | 5/1937 | Wagner | |

(Continued)

FOREIGN PATENT DOCUMENTS

| | | | | | |
|---|---|---|---|---|---|
| CH | 706643 | A2 | | 12/2013 | |
| DE | 897055 | C | * | 11/1953 | A22C 9/007 |
| FR | 2119439 | A7 | * | 8/1972 | A22C 9/007 |

*Primary Examiner* — Amy Vanatta
(74) *Attorney, Agent, or Firm* — Mueting, Raasch & Gebhardt, P.A.

(57) ABSTRACT

A felting device includes a rigid body having a bottom surface, an upper surface, and a perimeter surface. The bottom surface includes a plurality of grooves and a plurality of protrusions formed between the plurality of grooves. Each of the plurality of grooves includes a first side and a second side. The first side extends at an acute angle from the second side. The first and second sides define side surfaces of the each of the plurality of protrusions. The upper surface is opposite the bottom surface. The perimeter surface extends between the bottom surface and the upper surface. The perimeter surface defines perimeter sides of a set of protrusions of the plurality of protrusions that abut the perimeter surface.

19 Claims, 4 Drawing Sheets

(56) References Cited

U.S. PATENT DOCUMENTS

| | | | | | |
|---|---|---|---|---|---|
| 2,314,711 | A | | 3/1943 | Kelley et al. | |
| 2,423,963 | A | | 7/1947 | Coffman | |
| 2,445,444 | A | | 7/1948 | Mainwold | |
| 2,471,787 | A | | 5/1949 | Smith | |
| D159,908 | S | * | 8/1950 | Hulquist | 452/144 |
| 2,571,573 | A | | 10/1951 | Henrard | |
| D174,913 | S | | 6/1955 | Marcus | |
| D181,054 | S | * | 9/1957 | Hofberger | D11/1 |
| 3,100,312 | A | | 8/1963 | Williams | |
| 3,238,650 | A | * | 3/1966 | Mullen | D06F 75/38 38/93 |
| 3,330,077 | A | | 7/1967 | Kanbar et al. | |
| 3,363,276 | A | | 1/1968 | Thomas, Jr. | |
| 3,408,709 | A | | 11/1968 | Reitz | |
| 3,712,659 | A | | 1/1973 | Kneissl | |
| 4,055,029 | A | | 10/1977 | Kalbow | |
| 4,089,523 | A | | 5/1978 | Newburger et al. | |
| 4,595,622 | A | | 6/1986 | Schaefer | |
| 4,989,864 | A | | 2/1991 | Ubl | |
| 5,296,289 | A | | 3/1994 | Collins | |
| D347,367 | S | * | 5/1994 | Li | D7/682 |
| 5,310,181 | A | | 5/1994 | Chan | |
| 5,551,960 | A | | 9/1996 | Christianson | |
| 5,575,031 | A | * | 11/1996 | Chai | A47L 25/08 15/104.001 |
| 5,626,099 | A | | 5/1997 | Staller et al. | |
| 5,806,135 | A | | 9/1998 | Earle | |
| 5,844,518 | A | | 12/1998 | Berg et al. | |
| D423,888 | S | * | 5/2000 | Kaposi | D7/682 |
| 6,226,811 | B1 | | 5/2001 | Fagan | |
| D550,523 | S | * | 9/2007 | Stewart | A22C 9/004 D7/672 |
| 7,430,790 | B1 | | 10/2008 | Bowles et al. | |
| 7,862,408 | B1 | | 1/2011 | Weinstein | |
| 2004/0226577 | A1 | | 11/2004 | Schaaf | |
| 2010/0125961 | A1 | | 5/2010 | Tuman et al. | |
| 2013/0045654 | A1 | | 2/2013 | von der Fecht | |
| 2013/0255047 | A1 | | 10/2013 | Sasur | |

* cited by examiner

HANDHELD FELTING DEVICE

CROSS-REFERENCE TO RELATED APPLICATION

This Continuation-in-Part application claims the benefit of priority of U.S. patent application Ser. No. 13/912,573, filed Jun. 7, 2013, which claims priority to Provisional Application No. 61/690,236, filed Jun. 22, 2012, the contents of which are herein incorporated by reference.

BACKGROUND

The present invention relates to a felting device and, more particularly, to a felting device with a waffle maker pattern on the bottom surface.

Felt is made by a process called wet felting where the natural wool fibers, stimulated by friction and lubricated by moisture (usually soapy water), move at a 90 degree angle towards the friction source and then away again, in effect making little "tacking" stitches. While at any given moment only 5% of the fibers are active, the process is continual, so different 'sets' of fibers become activated and then deactivated, thereby building up the cloth. However, the devices used for felting may be difficult to use and may take a long amount time to perform the felting process.

As can be seen, there is a need for a felting device that may be quick and easy to use.

SUMMARY OF INVENTION

In one aspect of the present invention, a felting device comprises: a top portion comprising a top surface; and a bottom portion comprising a bottom surface, wherein the bottom surface comprises a plurality of intersecting grooves defining a plurality of blocks.

In another aspect of the present invention, a method of felting comprises: providing a felting device comprising: a top portion comprising a top surface; and a bottom portion comprising a bottom surface, wherein the bottom surface comprises a plurality of intersecting grooves defining a plurality of blocks; providing a piece of fabric; and rubbing a piece of fabric with the bottom surface of the felting device.

In another aspect of the present invention, a felting device comprises a rigid body having a bottom surface, an upper surface, and a perimeter surface. The bottom surface includes a plurality of grooves and a plurality of protrusions formed between the plurality of grooves. Each of the plurality of grooves includes a first side and a second side. The first side extends at an acute angle from the second side. The first and second sides define side surfaces of the each of the plurality of protrusions. The upper surface is opposite the bottom surface. The perimeter surface extends between the bottom surface and the upper surface. The perimeter surface defines perimeter sides of a set of protrusions of the plurality of protrusions that abut the perimeter surface.

In another aspect of the present invention, a felting device comprises a rigid monolithic body including a top surface, a bottom surface opposite the top surface, and a side surface extending between the top surface and the bottom surface. The side surface includes perimeter grooves. The bottom surface is patterned to include a plurality of grooves. A first set of the plurality of grooves extends in a first direction and a second set of the plurality of grooves extending in a second direction perpendicular to the first direction. The plurality of grooves forms sides of a plurality of protrusions. A top surface of each of the plurality of protrusions is planar.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device used for felting. The felting device may include a top portion and a bottom portion. The bottom portion may include a bottom surface with a waffle maker pattern. The waffle maker pattern may include a plurality of intersecting grooves that form protruding blocks. The top portion may include a handle for easily grasping and using the felting device.

The present invention may include a felting device that combines needle feltings, wet felting roving and silk together. The felting device of the present invention may be a palm wash board. The palm washboard may be hand made out of native hard wood for needle wet felted roving to a silk clothing article, such as a scarf. The felting device of the present invention facilitates a quicker and easier method of felting compared to other devices. There is no rapping or rolling needed.

Figure 1:
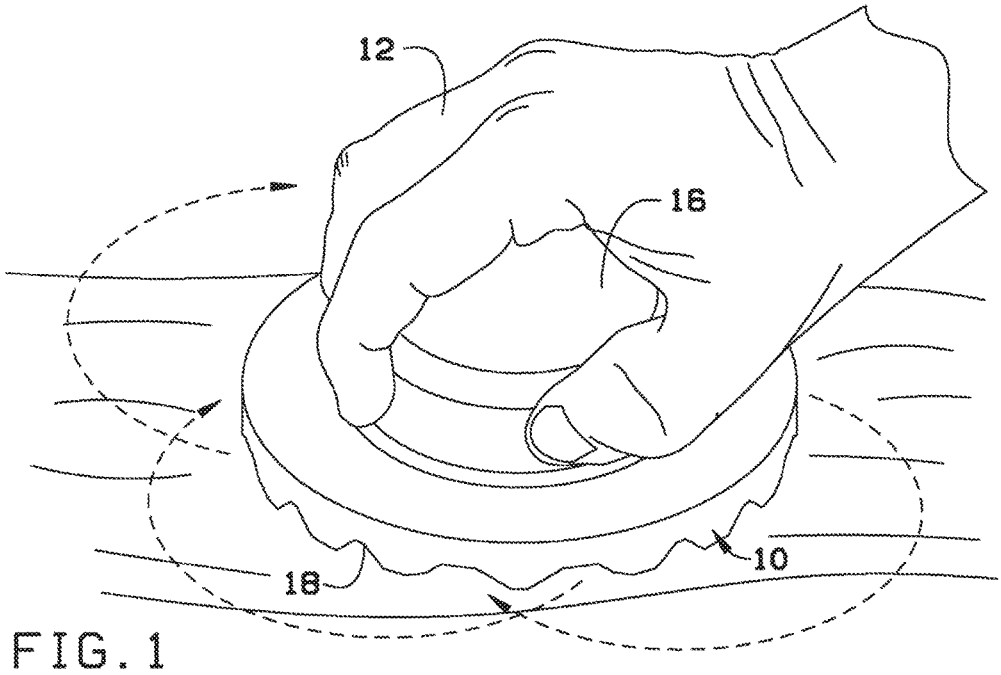
FIG. 1 is a perspective view of an embodiment of a felting device shown in use in accordance with aspects of the present disclosure.
Figure 2:
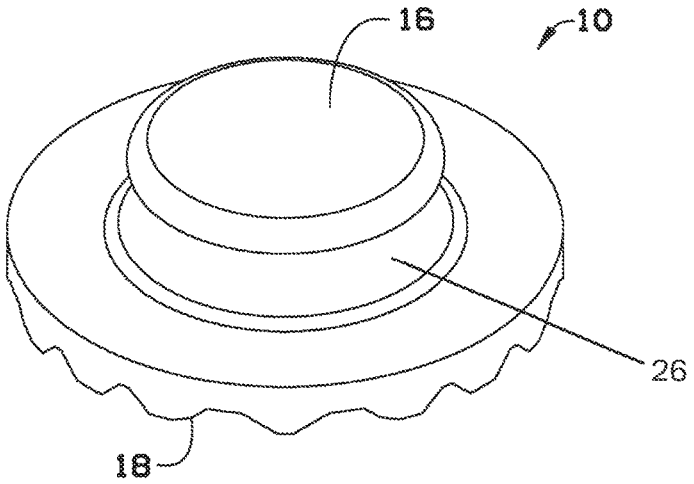
FIG. 2 is a top perspective view of the embodiment of FIG. 1.

Referring to the embodiment illustrated in FIGS. 1 through 5, the present disclosure includes a felting device 10. The felting device 10 may be a circular shape, similar to a puck. However, the felting device may be in any suitable shape, such as square shaped, triangular shaped, and the like. The felting device may include a top portion having top surface 24 and a bottom portion having a bottom surface 22. The top portion may be used to grasp the felting device 10. In certain embodiments, the top portion may include handle 16. In certain embodiments, the handle 16 may protrude from the top surface 24 and may include a ridge 26 at least partially around the circumference for a user to easily grasp the felting device 10. As illustrated in FIG. 1, an exemplary operator 12 may grasp the felting device 10 by the handle 16 during use.

Figure 3:
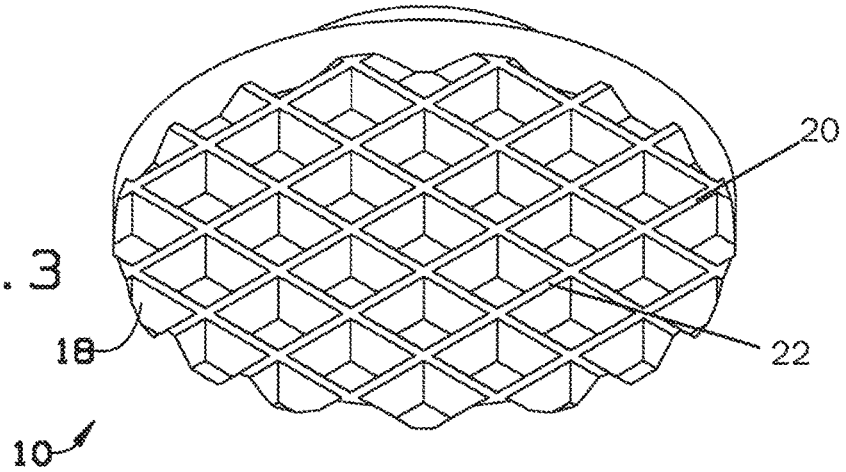
FIG. 3 is a bottom perspective view of the embodiment of FIG. 1.
Figure 4:
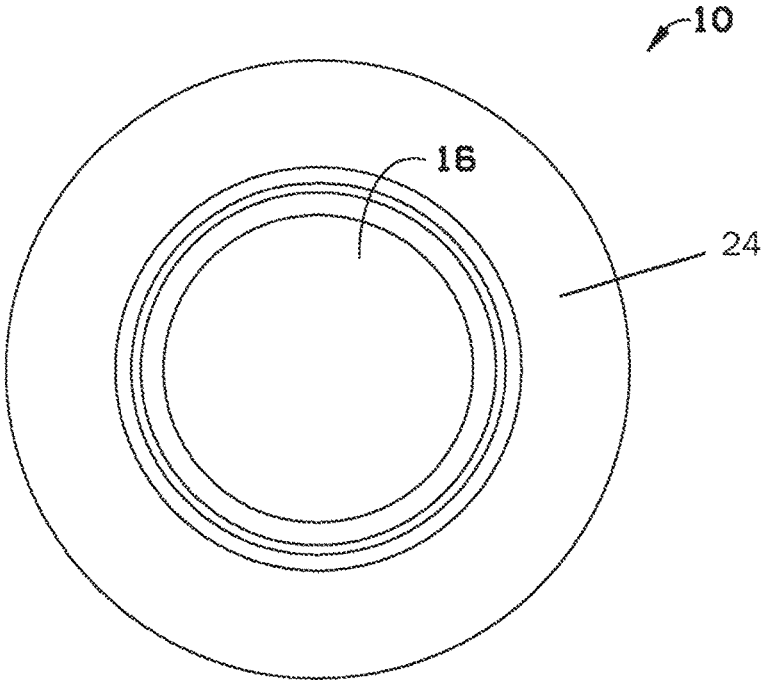
FIG. 4 is a top view of the embodiment of FIG. 1.
Figure 5:
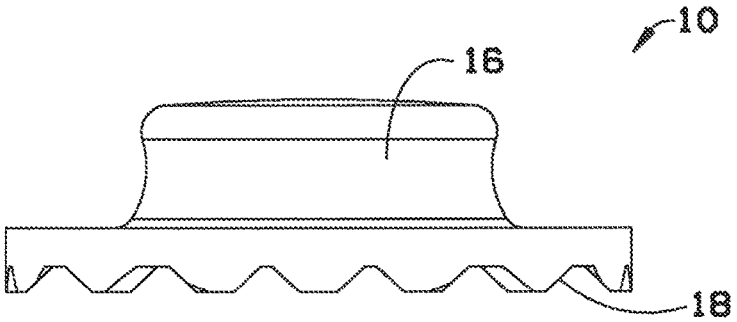
FIG. 5 is a side view of the embodiment of FIG. 1.

The bottom surface 22 of the present invention may have a waffle maker pattern. As illustrated in FIG. 3, the waffle maker pattern may include a plurality of intersecting grooves 20 defining plurality of protruding blocks 18, such as waffle teeth. The protruding blocks 18 may be in any desired shape. However, in certain embodiments, the blocks may have a pyramid shape with a substantially flat top. The plurality of intersecting grooves 20 may include a first set of grooves 20 that is substantially parallel to one another and a second set of grooves 20 that is substantially parallel to one another. The first set of grooves 20 intersects and is substantially perpendicular with the second set of grooves 20.

Various methods of fabricating the felting devices of the present disclosure are suitable. For example, three-dimensional (3D) printing is an additive manufacturing wherein successive layers of material are formed to fabricate the felting devices of the present disclosure. Alternatively, die casting, injection molding, or machine cutting can be used, for example. One exemplary method of fabricating the present invention may include the following. About a 5×5 inch piece of wood, such as maple, cedar, ash, walnut, cherry and the like may be ascertained. The piece of wood may be about 1 and ¾ inches thick. A router and ½ inch groove bit may be used to create the waffle pattern on the bottom surface 22. About a 4 and ¾ to about a 5 inch circle may be cut out of the 5 inch blocks. Then using a lathe, the piece may be designed to include about a 2 to about a 2 and ½ inch handle 16 protruding from the top surface 24. The device may then be coated with a two part epoxy finish.

Figure 6:
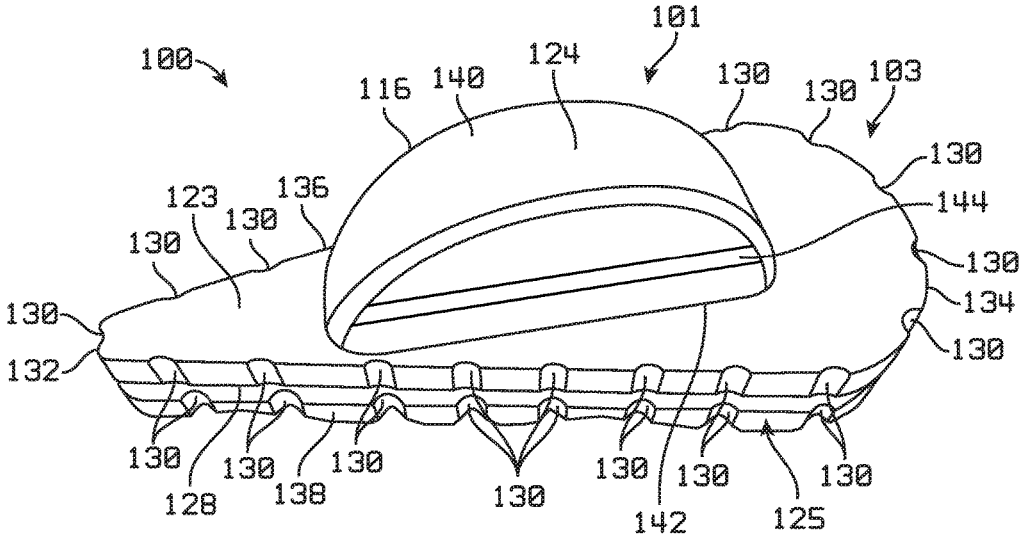
FIG. 6 is a top perspective view of another embodiment of the present disclosure.
Figure 7:
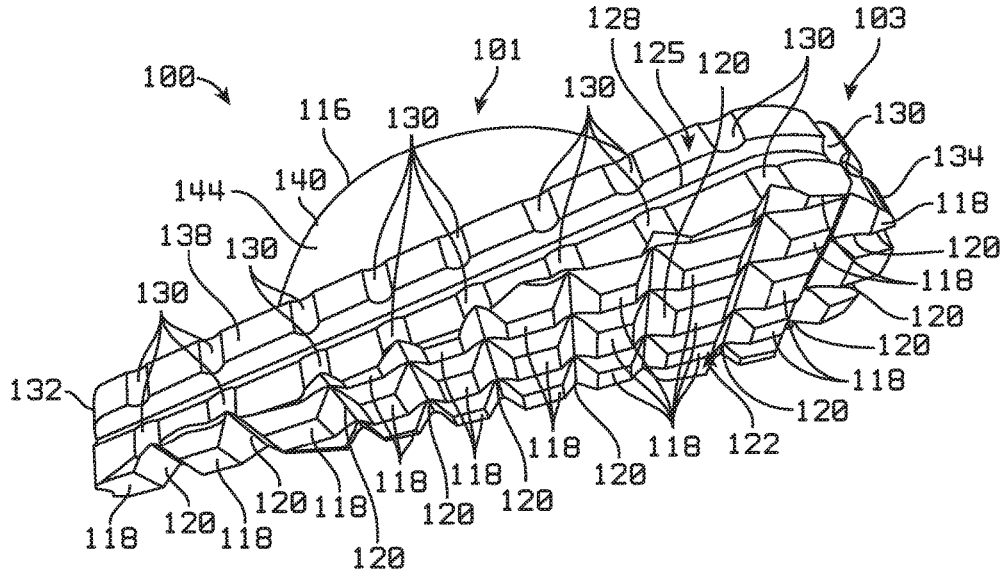
FIG. 7 is a bottom perspective view of the embodiment of FIG. 6.

Another embodiment of the present invention is illustrated in FIGS. 6 and 7. A felting device 100 can include a top portion 101 and a bottom portion 103. In one example, the top portion 101 and the bottom portion 103 are formed of the same material. The top portion 101 and the bottom portion 103 can be formed together, as a single monolithic unit, or coupled together. The felting device 100 is formed of one or more rigid materials. The felting device 100 can be formed of plastic, metal, or wood, or any combination thereof, for example.

The bottom portion 103 includes a bottom surface 122. The bottom portion 103 also includes an upper surface 123. The top portion 101 extends away from the upper surface 123 of the bottom portion 101. The bottom portion 103 also includes a side surface(s) 125 that extends between the bottom surface 122 and the upper surface 123 to form a perimeter of the bottom portion 103. In some embodiments, the side surfaces 125 are generally planar in a direction extending between, and perpendicular to, the upper surface 123 and the bottom surface 122. In other embodiments, the side surfaces 125 are curved or rounded along the direction extending between the upper surface 123 and the bottom surface 122. The bottom portion 103 can include a longitudinal ridge 128 that extends generally parallel to the upper surface 123 of the bottom portion 103. The longitudinal ridge 128 can be indented, or recessed into, the perimeter side surface 125. A plurality of perimeter grooves 130, or indents, can be included on the side surfaces 125. The perimeter grooves 130 can extend at least partially between the bottom and upper surfaces 122, 123. In one embodiment, the perimeter grooves 130 are disposed parallel to one another and are aligned to intersect with the grooves 120 disposed on the bottom surface 122. The side surface 125 can provide additional working surface to that provided by the bottom surface 122. The surfaces 122, 125 can be pressed, cut, burned, or otherwise formed through additive or deductive processes to form the desired patterns.

The bottom portion 103, and in particular, the bottom surface 122, can be monolithically formed. As illustrated in the embodiment of FIGS. 6 and 7, the bottom portion 103 can be generally triangular in shape when viewed from the top or the bottom and include a first end 132 and a second end 134. The first end 132 can be an acute angle formed at the intersection of a first side 136 and a second side 138. The first end 132 can be rounded. The second end 134 can also be rounded. The second end 136 can have a greater radius, or perimeter length, than the first end 132 and is extends between the first and second sides 136, 138 opposite the first end 132 to form a third side of the generally triangular shape.

The protrusions 118 can occupy a majority of the bottom surface 122 area, with grooves 120 extending between and separating adjacent protrusions 118 from one another. The grooves 120 are generally V-shaped with sides of the protrusions 118 defined by sides of the grooves 120. The side surface 125 of the bottom portion 103 can form sides of the protrusions 118 along the perimeter of the felting device 100. The protrusions 118 abutting the side surface 125 can be terminated by the side surface 125 and can be partial protrusions. In one example, the protrusions 118 are substantially uniform in depth and cross-sectional size across the bottom surface 122 of the felting device 100. In another example, the cross-sectional size and/or depth of the protrusions 118 can vary from one to another across the bottom surface 122. In one embodiment, a width of each groove 120 at a tip of the V-shape, adjacent a base of each protrusion 118, is smaller/less than a width or length of the protrusion 118 across the base of the protrusion 118. A depth of the protrusions 118 is provided as suitable for working with particular types and/or sizes of material. For example, a shallow depth of the protrusions can be suitable for working in a tight area such as a corner of a fabric material. A deeper depth of the protrusions can provide a working surface that allows a lofty fabric without mashing down the fibers. Deeper protrusions can be suitable for working locks of a curly shawl, for example.

The top portion 101 includes a top surface 124. The top portion 101 can include a handle 116 configured to be grasped in a single hand of a user. The handle 116 can be formed in variety of shapes suitable for grasping and as appropriate to facilitate the appropriate movement of the felting device. Additionally, the handle 116 can be sized and shaped to attach to the upper surface 123 of the bottom portion 103. In some examples, the handle 116 can be rectilinear shaped with a curved top or ends, round, mushroom shaped or other appropriate shape for grasping by the user. In some examples, the handle 116 can be semicircular or semi-elliptical and include a curved portion 140 extending away from the bottom portion 103 and a mounting surface 142 adjacent and coupled to the bottom portion 103. The handle 116 can include opposing first and second ends and opposing first and second sides. In some examples, the handle 116 includes an inset area 144 along opposing first and second sides or around at least a partial perimeter of the handle 116. The inset area 144 can extend parallel to the upper surface 123 of the bottom portion 103 and is configured to partially accommodate the fingers of a user and provide a gripping surface.

Figure 8:
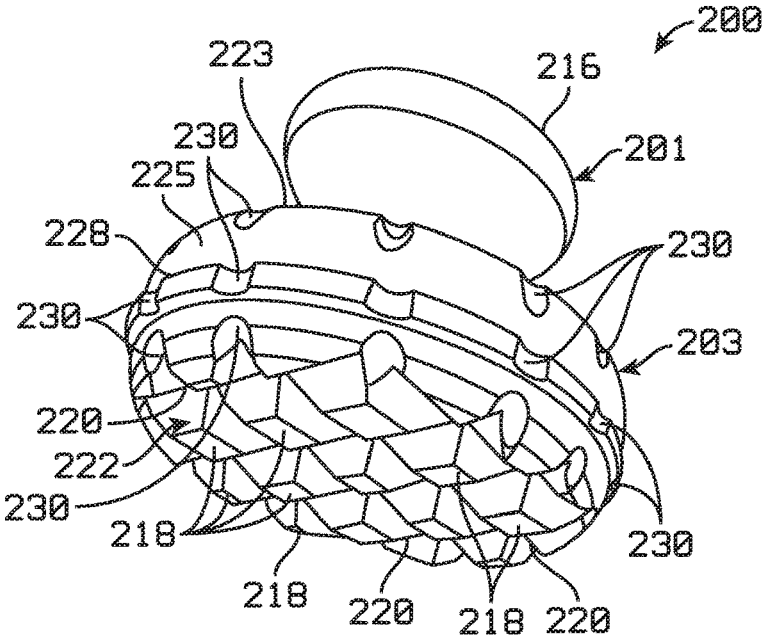
FIG. 8 is a bottom perspective view of another embodiment of the present disclosure.
Figure 9:
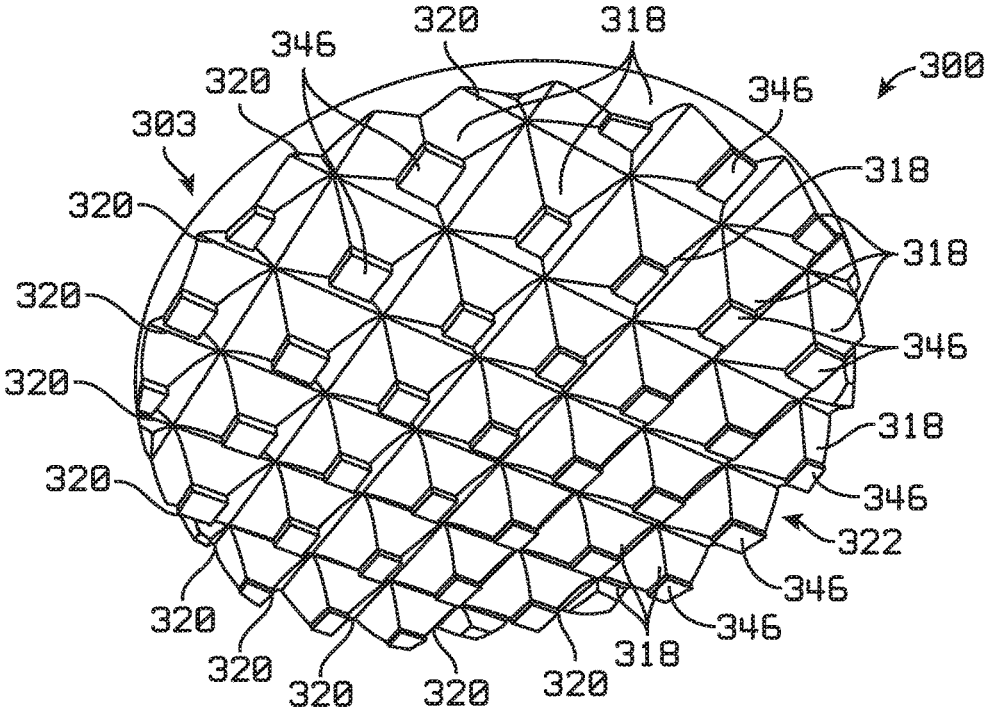
FIG. 9 is a bottom perspective view of another embodiment of the present disclosure.

With reference to the embodiment illustrated in FIG. 8, a felting device 200 includes a top portion 201 and a bottom portion 203 that are rounded. A longitudinal ridge 228 can be raised, or protrude from, a perimeter side surface 225 of a bottom portion 203. A plurality of perimeter grooves 230, or indents, can be included on a side surfaces 225 of the bottom portion 203. The perimeter grooves 230 can extend at least partially between a bottom surface 222 and an upper surface 223 of the bottom portion 203. In one embodiment, the perimeter grooves 230 extend through the longitudinal ridge 228. The perimeter grooves 230 can be disposed parallel to one another and are aligned to intersect with the grooves 220 disposed on the bottom surface 222 between projections 218. The side surface 225 can provide additional working surface to that provided by the bottom surface 222. The surfaces 222, 225 can be pressed, cut, burned or otherwise formed into the desired patterns FIG. 9 illustrates another embodiment of a felting device 300 in accordance with aspects of the present disclosure. Similar to previous embodiments, a bottom surface 322 includes projections 318 and grooves 320. In this embodiment, each of the projections 318 includes an extension 346 at a truncated tip of each of the projections 318. Each extension 346 can be rectangular have opposing and parallel first and second sides and opposing and parallel third and fourth sides perpendicular to the first and second sides. The first, second, third, and fourth sides extend away from a base of the projections 318 and are aligned with the sides of the projections 318.

A method of using the present invention is illustrated in FIG. 1 and may include the following. First an operator 12 may provide a piece of fabric 14. Then the operator 12 may rub the piece of fabric 14 with the bottom surface of the felting device 10 to create the felt. The rubbing may be in a circular motion, a straight line or the like.

It should be understood, of course, that the foregoing relates to exemplary embodiments of the invention and that modifications may be made without departing from the spirit and scope of the invention as set forth in the following claims.

What is claimed is:

1. A felting device comprising:

a rigid body having:

a bottom surface including a plurality of grooves and a plurality of protrusions formed between the plurality of grooves, each of the plurality of grooves including a first side and a second side, the first side extending at an acute angle from the second side, the first and second sides defining side surfaces of the each of the plurality of protrusions, each of the plurality of protrusions including a substantially flat top face extending between the side surfaces, wherein the bottom surface is configured to cause friction and activate fibers of a fabric material when moved along the fabric material;

an upper surface opposite the bottom surface;

a perimeter surface extending between the bottom surface and the upper surface, the perimeter surface defining perimeter sides of a set of protrusions of the plurality of protrusions that abut the perimeter surface; and a handle extending from the upper surface, the handle including a top curved surface configured to be grasped in a palm of a user's hand and side surfaces configured to accommodate fingers of the user's hand to facilitate moving the bottom surface along the fabric material, the handle including a grooved inset area configured to receive fingertips of a user.

2. The felting device of claim 1, wherein each of the plurality of protrusions includes a base and a top, wherein each base is wider than each top.

3. The felting device of claim 2, wherein each of the plurality of protrusions includes an extension at each of the tops, wherein each extension is rectangular having opposing and parallel first and second sides and opposing and parallel third and fourth sides perpendicular to the first and second sides, wherein the first, second, third, and fourth sides extend away from the base and are aligned with sides of the protrusions.

4. The felting device of claim 2, wherein the base of each of the plurality of protrusions has a width and a length defining the base, wherein both the width and the length are greater than a width of each of the grooves of the plurality of grooves adjacent to the base.

5. The felting device of claim 1, wherein the plurality of grooves openingly terminate at the perimeter surface.

6. The felting device of claim 1, wherein the perimeter surface defines generally triangular upper and bottom surfaces.

7. The felting device of claim 6, wherein the perimeter surface includes first and second sides having a first length greater than a second length of a third side.

8. The felting device of claim 1, wherein the perimeter surface includes a perimeter set of grooves extending at spaced intervals, wherein the spaced intervals are configured such that the perimeter set of grooves intersect with the grooves on the bottom surface, and wherein the perimeter set of grooves intersect with the upper surface.

9. The felting device of claim 1, wherein the perimeter surface includes a longitudinal ridge extending parallel to the upper surface.

10. The felting device of claim 1, wherein working surfaces of the rigid body include the bottom surface and the perimeter surface.

11. The felting device of claim 1, wherein the rigid body is formed by three-dimensional printing.

12. The felting device of claim 1, wherein the felting device is formed by injection molding.

13. The felting device of claim 1, wherein the rigid body is comprised of plastic, metal or wood.

14. A felting device comprising:

a rigid monolithic body including:

a top portion including a top surface, a bottom surface opposite the top surface, and a handle protruding from the top surface, the handle including an upper curved surface configured to be grasped in a palm of a user's hand and side surfaces configured to accommodate fingers of the user's hand to facilitate moving the bottom surface along the fabric material, and a side surface extending between the top surface and the bottom surface, the side surface including perimeter grooves terminating at the top surface and at the bottom surface, wherein the bottom surface is patterned to include a plurality of grooves, a first set of the plurality of grooves extending in a first direction and a second set of the plurality of grooves extending in a second direction perpendicular to the first direction, the plurality of grooves forming sides of a plurality of protrusions, a top surface of each of the plurality of protrusions is planar.

15. The felting device of claim 14, wherein the handle includes a groove extending generally parallel to the top surface.

16. The felting device of claim 14, wherein each of the plurality of protrusions is shaped as a truncated rectangular pyramid.

17. The felting device of claim 14, wherein the perimeter grooves intersect with the plurality of grooves.

18. The felting device of claim 14, wherein the rigid monolithic body is formed by three-dimensional printing, injection molding, or machine cutting.

19. A felting device comprising:

a rigid body having:

a bottom surface including a plurality of grooves and a plurality of protrusions formed between the plurality of grooves, each of the plurality of grooves including a first side and a second side, the first side extending at an acute angle from the second side, the first and second sides defining side surfaces of the each of the plurality of protrusions;

an upper surface opposite the bottom surface; and a perimeter surface extending between the bottom surface and the upper surface, the perimeter surface defining perimeter sides of a set of protrusions of the plurality of protrusions that abut the perimeter surface, wherein each of the plurality of protrusions includes a base and a top, wherein each base is wider than each top, wherein each of the plurality of protrusions includes an extension at each of the tops, wherein each extension is rectangular having opposing and parallel first and second sides and opposing and parallel third and fourth sides perpendicular to the first and second sides, and wherein the first, second, third, and fourth sides extend away from the base and are aligned with sides of the protrusions.

* * * * *